United States Patent [19]

Rausing

[11] Patent Number: 4,566,928

[45] Date of Patent: Jan. 28, 1986

[54] METHOD OF MANUFACTURING PACKING CONTAINER HAVING TEAR-UP OPENING ARRANGEMENT

[75] Inventor: Hans A. Rausing, Lund, Sweden

[73] Assignee: Tetra Pak International AB, Lund, Sweden

[21] Appl. No.: 518,489

[22] Filed: Jul. 29, 1983

Related U.S. Application Data

[62] Division of Ser. No. 225,602, Jan. 16, 1981, Pat. No. 4,410,128.

[30] Foreign Application Priority Data

Jan. 21, 1980 [SE] Sweden ..... 8000471

[51] Int. Cl.[4] ..... B29D 23/10

[52] U.S. Cl. ..... 156/217; 156/227; 156/252; 493/87

[58] Field of Search ..... 493/87, 212, 377, 923, 493/930, 963, 116; 229/17 R, 17 G; 156/250–253, 226, 227, 204, 217; 383/47

[56] References Cited

U.S. PATENT DOCUMENTS

| | | | |
|---|---|---|---|
| 3,952,940 | 4/1976 | Malcolm | 229/17 R X |
| 4,098,406 | 7/1978 | Otten et al. | 229/DIG. 5 X |
| 4,248,351 | 2/1981 | Berg | 229/17 R X |

*Primary Examiner*—David Simmons

*Attorney, Agent, or Firm*—Burns, Doane, Swecker & Mathis

[57] ABSTRACT

A tear-up opening arrangement for a packing container which is manufactured from a plane packing material web by folding is disclosed. The packing material is pierced through along a cut line which is situated alongside or in the vicinity of a base line of a sealing fin projecting from the packing container. The cut line is covered along the inside of the packing container by a thin, molecular-oriented plastic strip whose direction of orientation coincides with the extension of the cut line. The cut line has two end portions extending on either side of the apex of a triangular lug of the container and a center portion extending parallel to, but at a distance from, a line through the apex and the end portions.

6 Claims, 4 Drawing Figures

METHOD OF MANUFACTURING PACKING CONTAINER HAVING TEAR-UP OPENING ARRANGEMENT

This application is a division, of application Ser. No. 225,602, filed Jan. 16, 1981, now U.S. Pat. No. 4,410,128.

BACKGROUND AND SUMMARY OF THE PRESENT INVENTION

The present invention relates to a liquid-tight packing container provided with a tear-up opening arrangement of the type which is manufactured from a plane packing material web or a plane packing material sheet by folding so as to form a closed hollow body. At least one side wall of the container is provided with a sealing fin projecting from the side wall of the packing container, which extends over the side wall and up to the apex of a double-walled triangular lug connected with the side wall. The lug is formed during the folding and lug is intended to form a pouring spout for the decanting of the contents enclosed in the packing container when the packing container has been opened.

The invention also relates to the manufacture of the abovementioned packing container.

Liquid goods, such as e.g. milk, are packed and distributed at the present time almost exclusively in non-returnable packages which are manufactured from plastics or plastic-coated paper. The latter is more common since a packing material which consists of a combination of paper and plastics will be cheaper than a wholly plastic package and will be more acceptable from an environmental point of view. In accordance with modern principles of packaging, the packing material is supplied in the form of a web consisting of plastic-coated paper. The web can be wound up on a magazine roll to facilitate transport and handling, and also to improve hygiene since the actual packing surface is protected in rolled-up condition against dirt, moisture and external influences. The formation of the packages can be realized so that the said web is folded to a tube by joining together the longitudinal edges of the web through combining the plastic layers in the contact zones by surface melting. The tube thus formed is filled with the intended contents and divided up along narrow transverse sealing zones situated at a distance from each other along the longitudinal axis of the tube. Whereupon the packing units formed are separated by cuts in the transverse sealing zones and shaped by folding to their final package form with the help of folding lines, so-called crease-lines, provided beforehand on the packing material web.

Packages of the abovementioned type can be manufactured in high-speed packing machines and in a very hygienic manner, since the side of the packing material which is intended to form the inside of the packing container is exposed only to a very small degree, and it has been found possible, with the help of the packing technique, to manufacture wholly aseptic packages by sterilizing the inside of the packing material web before or in connection with the tube formation. However, it is a problem to arrange a readily functioning opening for the packing container, since an opening direction entails a weakening of the packing material, which means that such a weakened opening direction may easily bring about leakages, because the opening opens up during handling, for example, in connection with transport. A variety of different opening arrangements has been suggested and used, and in the majority of cases these consist of a tearing perforation, which penetrates the paper layer but not the plastic layer and is arranged along a defined tearing length. As mentioned above, such tearing perforations have to be realized as a compromise between openability and tightness demands, and great demands on tolerances are made in the perforating operation, since the plastic layer may not be damaged. Among other things it has also been suggested to pierce fully through the packing material with a perforation or cut line, which perforation or cut line is restored after the punching operation with the help of a thin plastic strip which is firmly welded over the punching region against the plastic-coated inside of the packing material. In many cases these opening arrangements have proved to function satisfactorily, but it is imperative that adhesion should be very good right up to the cut edge, since otherwise the inner plastic strip, which is constituted of plastic material, will be stretched and drawn out in a rubberlike manner which brings about difficulties during the opening operation.

The present invention, however, provides a solution to the problem and relates to an opening arrangement in which the packing material forming the packing container is pierced through along a line situated alongside or in the vicinity of the base line of the sealing fin on both sides of the sealing fin, and which extends from the apex of the said triangular lug to a point situated on the said side wall. The pierced portion of the packing material as a whole is covered by a plastic strip which is fixed in liquid-tight manner to the side of the packing material which forms the inside of the packing container. The plastic strip is strongly molecular-oriented in its longitudinal direction, and parts of the plastic strip are attached to one another and fixed in the said sealing fin.

Hence the principle, known in itself, is used that plastic material can be orientation-stretched and that the tearability in the direction of orientation is greatly improved whilst tearability in transverse direction is diminished to the same degree.

BRIEF DESCRIPTION OF THE DRAWINGS

The invention will be described in the following with reference to the enclosed drawing wherein.

DETAILED DESCRIPTION OF THE PREFERRED EMBODIMENT

Figure 1:
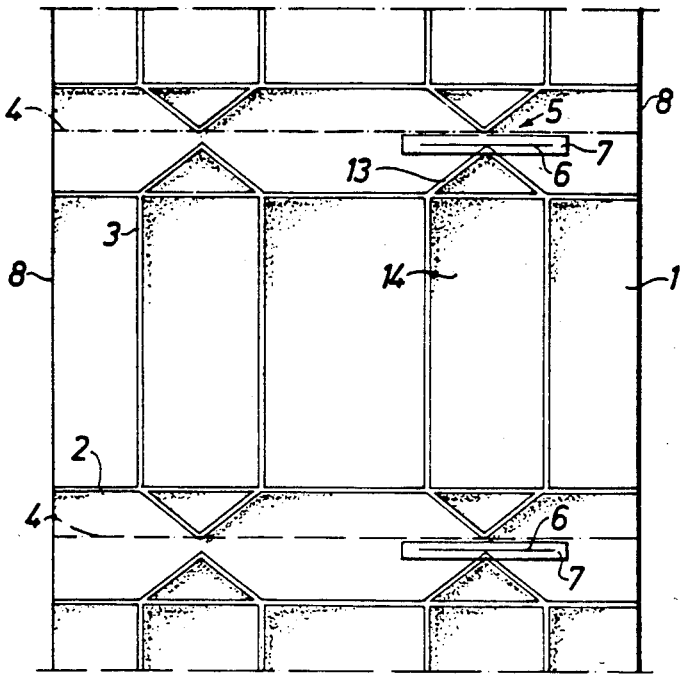
FIG. 1 is an overhead view of a piece of weblike packing material.

The part of a continuous packing material web 1 shown in FIG. 1 is provided with a repeated crease line pattern 2,3 to facilitate the folding of the web 1 in connection with the forming of the individual packing containers. The boundaries between successive parts of the packing material web, which are intended to form individual packing containers, indicated by a numeral 4. As can be seen in FIG. 1, the boundary lines 4 extend between the converging crease lines which are arranged so as to facilitate the formation of the double-walled triangular lugs, mentioned earlier, which are formed at the side edges of the packing container. Directly underneath the said boundary lines 4 a cut line 6, piercing through the packing material web, is provided. The cut line 6 is situated so that it touches the apex 5 of two of the converging crease lines 13, or crosses the said crease lines 13 slightly, near the apex 5. The cut line 6, which may also be an easily openable perforation, is covered along the plastic coated inside of the packing material web 1 with a longitudinal plastic strip 7 e.g. a polyethylene strip. The strip 7 is heat-sealed to the plastic coating of the web 1 in such a manner that the cut line 6 is wholly covered. The heat sealing must be carried out in such a manner that the plastic strip 7 does not shrink, and this can be achieved in that the strip 7 is pressed against the web 1 at a high pressure and is retained in this pressed-down position until the plastic material has cooled down and stabilized. It is also possible, moreover to apply the strip 7 with the help of a hot melt or other adhesive, whose adhesion temperature is lower than the shrinkage temperature of the plastic strip.

As is evident from FIG. 1 the punching of the cut lines 6 and the application of the strip 7 are repeated for each complete package pattern. The cut line 6 is arranged so that its two parts on either side of the apex 5 of the crease lines 13 are of approximately equal length, and the cut line is oriented right-angled to the longitudinal direction of the packing material web 1. The length of the cut line 6 can be varied but must not exceed the width of the side panel 14.

The packing material web shown in FIG. 1 is converted to packing container by joining together its edge regions in an overlap joint and combining the plastic coatings on the web 1 by surface melting. The tube formed is filled with contents and is pressed flat and sealed transversely along the zones of the tube which are marked by the boundary lines 4. Thereupon the folding of the sealed-off parts of the tube takes place along crease lines 2, 3, 13 of the crease line pattern, so as to form parallelepipedic containers which are separated from the tube by cuts in the transverse sealing zones.

Figure 2:
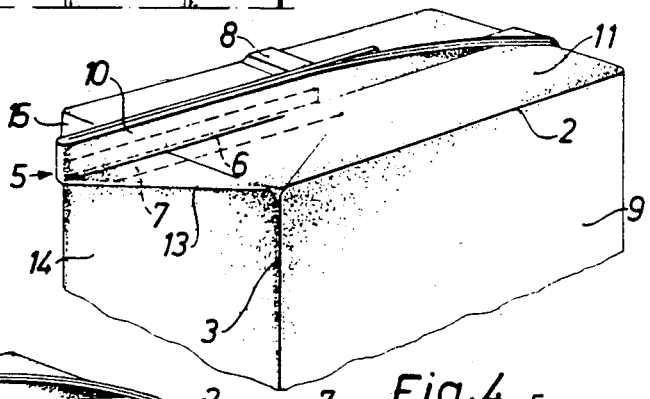
FIG. 2 is a perspective view of a part of a packing container which is provided with an opening arrangement in accordance with the invention.

On shaping the packages parallelepipedic packing containers are formed of the type which is shown partly in FIG. 2.

As is evident from FIG. 2 a double-walled triangular lug 15 is formed, inter alia, in the connection line between a side face 14 and a top face 11 of the packing container. The lug 15 can be folded down against the package side 14 and fixed in folded-down position. Above the top face 11 and the triangular lugs 15 extends a sealing fin 10 whose upper edge corresponds in principle to the imaginary boundary line 4 on the packing material web 1. The packing material has been joined together in the sealing fin such that the plastic layers facing one another are melted together. The sealing fin 10 can be raised in the manner which is shown in FIG. 2 after the triangular lug 15 has been detached from the side face 14 and has been raised to the position shown.

As can be seen from FIG. 2 the cut line 6 appears on either side of the base line of the sealing fin 10 and extends inwardly up to a point on the top face or upper end face 11 of the packing container. The cut line 6 is thus doubled around the apex 5 of the triangular lug and the two parts of the cut line which are present on either side of the apex 5 are arranged alongside one another. The cut line 6 is covered along the inside of the packing material, in a manner described earlier, by the longitudinally oriented plastic film 7 which is sealed to the inside of the package in the region of the cut 6. A part of the strip 7 has been incorporated in the sealing fin 10. Thus these parts of the plastic strip 7 are combined and are taken up between packing material layers in the fin 10, while the parts of the strip 7 which are situated "below" the cut line 6 rest against the inside of the top side 11 of the packing container and the triangular lug 15.

Figure 3:
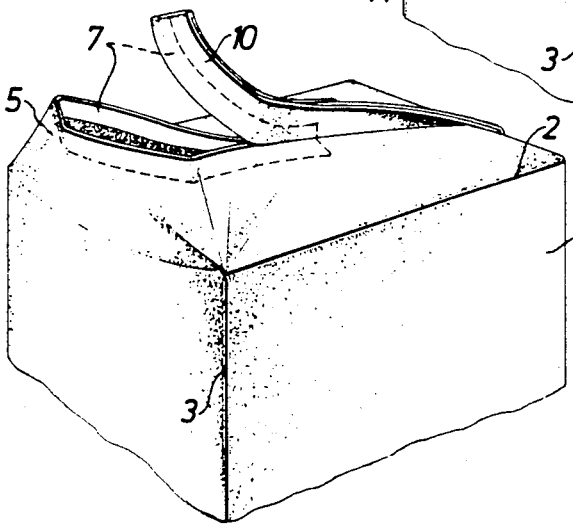
FIG. 3 is a perspective view of the packing container in accordance with FIG. 2 after it has been opened.

As mentioned earlier, the plastic strip 7 is strongly molecular-oriented in its longitudinal direction, which means that it can easiy be torn up in this direction but not in transverse direction. As long as the triangular fin 15 is folded down against the side of the package 14 and is sealed in this folded-down position, no stresses arise in the strip 7 in its longitudinal direction. But when the triangular lug 15 has been raised up to the position shown in FIG. 2, the projecting fin 10 can be readily gripped between fingers and the fin ripped up along the cut line 6, whereby an opening of the type as shown in FIG. 3 is produced. The ripped up part of the fin can be formed to a pouring hole of rhomboidal cross-section as shown in FIG. 3.

The plastic strip 7 is applied advantageously in such a manner that the longitudinally oriented plastic strip is rolled off a magazine roll and advanced over the intermittently or continuously fed web 1, which has been provided beforehand with punched-through cut lines 6. A piece of the web 7 move forwards, whose length exceeds a little the length of the cut line 6, is separated from the rest of the web and is located over the cut line so that the longitudinal axis of the cut line and the direction of orientation of the strip coincide. As mentioned earlier, the attachment of the strip 7 may be done with the help of heat and pressure, but it has to be ensured that the strip remains in pressed-down position until it has stabilized, since otherwise the orientation tensions in the strip may be released, meaning that the material would shrink. The strip 7 can also be applied with the help of an adhesive, e.g. a hot melt.

Figure 4:
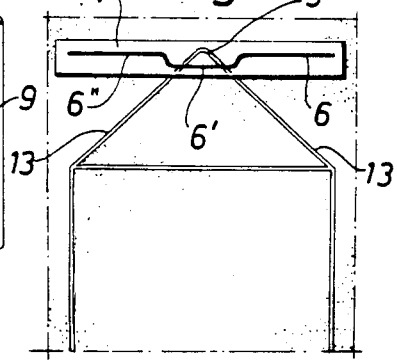
FIG. 4 is an enlarged overhead view of an alternate embodiment of a portion of the web like packing material of FIG. 1.

In the course of the folding of the packing material which contains the cut 6 around the apex 5 of the triangular lug 15 it is possible sometimes, and especially when thick packing material is used, that stresses of such magnitude arise in the plastic strip 7 underneath the cut line 6 that it breaks, which, of course, causes leakage. To avoid this danger with thick packing material, the cut line 6 may instead be disposed in accordance with FIG. 4. In this alternate embodiment, the cut line 6 consists of three parts parallel with one another, a central part 6' and two outer parts 6'' the central part 6' being situated a little below the apex 5 of the converging crease line 13. The main part of the cut line 6, that is to say the outer parts 6'', however are still situated along an imaginary straight line through the apex 5, so that the cut line substantially follow the base line of the sealing fin 10 and only in the region of the apex of the triangular lug 15 will depart from the base line of the fin. The parts 6' and 6'' of the cut line are connected to one another along a preferably short connecting cut line so that the continuity of the tearing operation should not be lost.

It has been found that the opening arrangement in accordance with the invention has a very good tearing function and thus can be readily opened, whilst at the same time "spontaneous" openings owing to stresses arising during the handling and transport of the packing containers do not occur. Since the opening arrangement moreover is simple and inexpensive to manufacture, it presents appreciable advantages over opening arrangements used up to now.

The principles, preferred embodiments and modes of operation of the present invention have been described in the foregoing specification. The invention which is intended to be protected herein should not, however, be construed as limited to the particular forms disclosed, since these are to be regarded as illustrative rather than restrictive. Variations and changes may be made by those skilled in the art without departing from the spirit of the present invention.

What is claimed is:

1. A method of manufacturing a plurality of packing containers, comprising:

piercing a web of packing material with a plurality of cut portions to form a cut line, first and second cut portions being arranged along a common, straight line with an interruption therebetween, a third cut portion extending along said interruption and parallel to and spaced from said first and second cut portions, and additional cut portions for joining ends of said third cut portion to a respective end of said first and second cut portions;

covering said cut line with strip means;

joining edge regions of said web of packing material to form a tube;

pressing flat and sealing discrete regions transversely to an axis of said tube to form individual packing containers, wherein said cut line is so situated on said web of packing material that a boundary line of one of said discrete regions generally coincides with a center of said interruption so that when said indidvidual packing containers are formed the first cut portion of said cut line is in facing parallel relationship to the second cut portion of said cut line; and forming a triangular lug on each of said individual packing containers, said first and second cut portions of said cut line extending on either side of an apex of said triangular lug with said common, straight line of said first and second cut portions passing through said apex and said third cut portion of said cut line being spaced from said apex.

2. The method of claim 1 further comprising:

sealing said strip means to said web of material over said cut line in a liquid-tight manner.

3. A method of manufacturing a plurality of packing containers, comprising:

piercing a web of packing material with a plurality of cut portions to form a cut line, first and second cut portions being arranged along a common, straight line with an interruption therebetween, a third cut portion extending along said interruption and parallel to and spaced from said first and second cut portions, and additional cut portions for joining ends of said third cut portion to a respective end of said first and second cut portions;

covering said cut line with strip means;

joining edge regions of said web of packing material to form a tube;

pressing flat and sealing discrete regions transversely to an axis of said tube to form individual packing containers, wherein said cut line is so situated on said web of packing material that a boundary line of one of said discrete regions generally coincides with a center of said interruption so that when said individual packing containers are formed the first cut portion of said cut line is in facing parallel relationship to the second cut portion of said cut line;

providing said web of packing material with a plurality of crease lines to facilitate folding each individual packing container into a shaped container; and forming a triangular lug on each of said individual packing containers, said first and second cut portions of said cut line extending on either side of an apex of said triangular lug with said common, straight line of said first and second cut portions passing through said apex and said third cut portion of said cut line being spaced below said apex.

4. The method of claim 3 further comprising:

forming a sealing fin on each of said individual packing containers, said first and second cut portions of said cut line being situated along a base line of said sealing fin and said third cut portion being spaced below said base line.

5. The method of claim 3, wherein said strip means comprises a longitudinally molecular-oriented plastic strip, said plastic strip being easily tearable in a longitudinal direction and being not easily tearable in a direction transverse to said longitudinal direction, further comprising the step of arranging said strip to cover said cut line such that the longitudinal direction of the strip coincides with the direction of the first, second and third cut portions.

6. A method of manufacturing a plurality of packing containers, comprising:

piercing a web of packing material with a plurality of cut portions to form a cut line, first and second cut portions being arranged along a common, straight line with an interruption therebetween, a third cut portion extending along said interruption and parallel to and spaced from said first and second cut portions, and additional cut portions for joining ends of said third cut portion to a respective end of said first and second cut portions;

covering each of said cut lines with a strip of molecular oriented plastic;

arranging said strip along the cut line such that the strip is easily tearable in a direction coinciding with said first, second and third cut portions of said cut line;

sealing said strips to said packing material over said cut lines to prevent fluid leakage through said cut lines;

joining edge regions of said web of packing material to form a tube;

pressing flat and sealing discrete regions transversely to an axis of said tube to form individual packing containers, wherein said cut line is so situated on said web of packing material that a boundary line of one of said discrete regions generally coincides with a center of said interruption that when said individual packing containers are formed the first cut portion of said cut line is in facing parallel relationship to the second cut portion of said cut line;

providing said web of packing material with a plurality of crease lines; and folding each individual packing container into a formed container having a triangular lug, said first and second cut portions of said cut line extending on either side of an apex of said triangular lug with said common, straight line of said first and second cut portions passing through said apex and said third cut portion of said line being spaced below said apex.

* * * * *